US005463969A

United States Patent [19]

Hoyt

[11] Patent Number: 5,463,969

[45] Date of Patent: Nov. 7, 1995

[54] FREE STANDING BOOM WITH SUBSTANTIALLY CONSTANT LEECH TENSION

[76] Inventor: John G. Hoyt, Two Harbor View Dr., Newport, R.I. 02840

[21] Appl. No.: 261,891

[22] Filed: Jun. 15, 1994

Related U.S. Application Data

[63] Continuation-in-part of Ser. No. 971,545, Nov. 5, 1992, abandoned, and Ser. No. 145,781, Oct. 29, 1993, abandoned.

[51] Int. Cl.[6] ..... B63B 35/00

[52] U.S. Cl. ..... 114/39.001; 114/89

[58] Field of Search ..... 114/89, 90, 93, 114/97, 98, 102–107, 39.1; D12/303

[56] References Cited

U.S. PATENT DOCUMENTS

| | | | |
|---|---|---|---|
| 2,107,303 | 2/1938 | Ljungstrom | 114/106 |
| 3,749,042 | 7/1973 | Jackson | 114/106 |
| 3,835,804 | 9/1974 | Jackson | 114/107 |
| 4,061,101 | 12/1977 | Cook | 114/106 |

FOREIGN PATENT DOCUMENTS

| | | | |
|---|---|---|---|
| 2496046 | 6/1982 | France | 114/90 |
| 3703744 | 8/1988 | Germany | 114/107 |

*Primary Examiner*—Edwin L. Swinehart
*Attorney, Agent, or Firm*—Barlow & Barlow, Ltd.

[57] ABSTRACT

A sailboat provided with a free standing boom and in one version with a free standing mast that is separate from and immediately adjacent and forward of the boom mounting. The boom is separately mounted to be self supporting by a stub shaft in a bearing socket and the shaft is rotatable about an axis that is parallel to the line passing through the luff of the sail with which the boom is associated. The boom may also be a jib boom and in that case the rotatable mounting is closely adjacent the headstay.

5 Claims, 2 Drawing Sheets

FREE STANDING BOOM WITH SUBSTANTIALLY CONSTANT LEECH TENSION

This application is a continuation in part of my application Ser. No. 07/971,545, filed Nov. 5, 1992 and my application Ser. No. 08/145,781 filed Oct. 29, 1993, both abandoned.

BACKGROUND OF THE INVENTION

The present invention relates to a sailboat and more particularly, to the rig utilizing a free standing mainsail boom.

There are many small boats represented in the prior art that include masts that are stepped by passing through an aperture in the deck and thence into some support means that is connected to the hull of the boat as for example, a mast step or a mast receiving sleeve. Sailfish and Lasers are at least two examples of this type of sailboat having this form of construction for supporting essentially a free standing mast, that is one that does not utilize shrouds. Booms, however, are all attached to the mast in a non-rigid pivoting manner. When the sail, which is generally attached to the mast at the luff edge thereof and also to the boom at the tack and at the clew, there are loads that are developed on the mast by this type of arrangement that are significant. In small boats, it is desirable to reduce the size of the mast to improve the performance and stability of the boat, but this has been difficult in the past due to the significant loads that have been developed. It is also desirable to provide a self supporting boom that in the past has generally been achieved by the use of a hydraulic vang. Jib booms are notoriously poor performers off the wind as they are not able to be vanged. Thus a jib boom swivel mounted at its forward end merely is able to be effective over a small arc while the boom lies essentially over the hull, since it can not be downwardly loaded except in that small arc.

One approach is seen in German Published Application 37 03744, where a self supporting boom is described along with tensioning of the sail leech on the wind and a loosening of the leech tension when the boom is let off, i.e. reaching or running.

It is the prime object of the instant invention to improve on the prior art with a structure by maintaining constant leech tension on the sail throughout boom movement. The object is achieved with a boom having an arcuate forward end terminating in a stub shaft that is received in a socket immediately adjacent and aft of the luff of the sail as structurally permissible, the stub shaft extending on an axis parallel to the luff of the sail.

It is a further object of the invention to provide a self supporting jib boom.

It is a still further object of the invention to eliminate topping lifts and some of the other problems associated with many of the conventionally rigged sailboats including clearance problems due to the swinging of the boom across the cockpit. A more specific object is to eliminate the load between the mast and the boom created by the forces developed by the sail.

SUMMARY OF THE INVENTION

The present invention avoids some of the problems in conventional rigging and utilizes a boom which is free standing and which has an arcuate forward end terminating in a stub shaft that is inserted into a tubular holder through the deck, the portion aft of the curved portion rising upwardly over the cockpit or foredeck area of the sailboat. The tubular holder extends at the same angle as the luff of its associated sail. Usual sheet means are affixed to the boom for trimming and an outhaul for pulling the clew of the sail to the outer end of the boom is provided as is usual in rigging sailboats. In one form a free standing main mast is stepped through the deck into a tubular mast holder that is affixed to the hull and the keelson in conventional constructional methods. The mast is provided at its lower end, above deck level, with a drum about which a furling line extends and a sail is fitted to the mast by affixing the luff thereof to the mast in known manners. Alternate forms of restraining the forward end of the boom may suggest themselves so long as the boom is self supporting and swingable. The preferred form is a tubular boom holder having an anti friction sleeve or roller bearing socket at the deck level receiving the stub shaft to provide freedom of rotation of the boom. In another form the boom is used as a jib boom and the stub shaft axis is rotatably positioned in the holder on a axis that is parallel to an imaginary line extending along the luff of a sail with which the boom is associated.

The invention in its basic form is a free standing self supporting boom with an arcuate or curved forward end terminating in a stub shaft that is located as close as structurally permissible to an imaginary line of extension of the luff of the sail, the stub shaft extending at an angle of rake substantially parallel to the luff of the sail that the boom tends. The boom will accordingly move in a fashion whereby the leech tension is maintained constant providing the effect of a vanged boom.

DESCRIPTION OF THE PREFERRED EMBODIMENT

Figure 1:
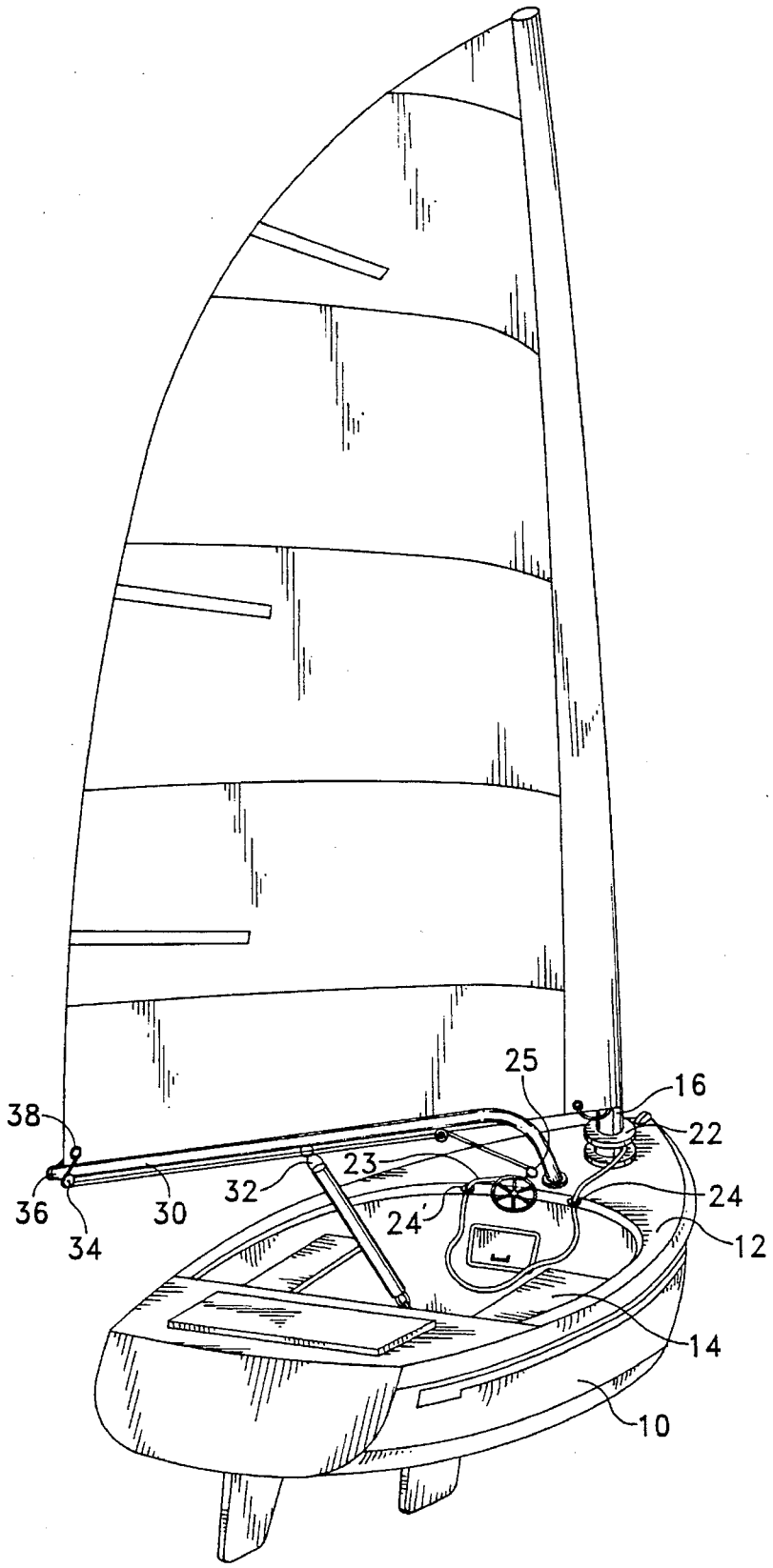
FIG. 1 is a perspective view of a sail boat incorporating the rig embodying the principles of the present invention.

Referring to the drawings, there is illustrated a sail boat hull 10 having a deck 12 with an open cockpit area 14. A mast 16 is stepped in a extended socket 18 which has a top bearing 20. A furling drum 22 is fitted about the mast 16 and passing about this drum is a furling line 23.

Figure 2:
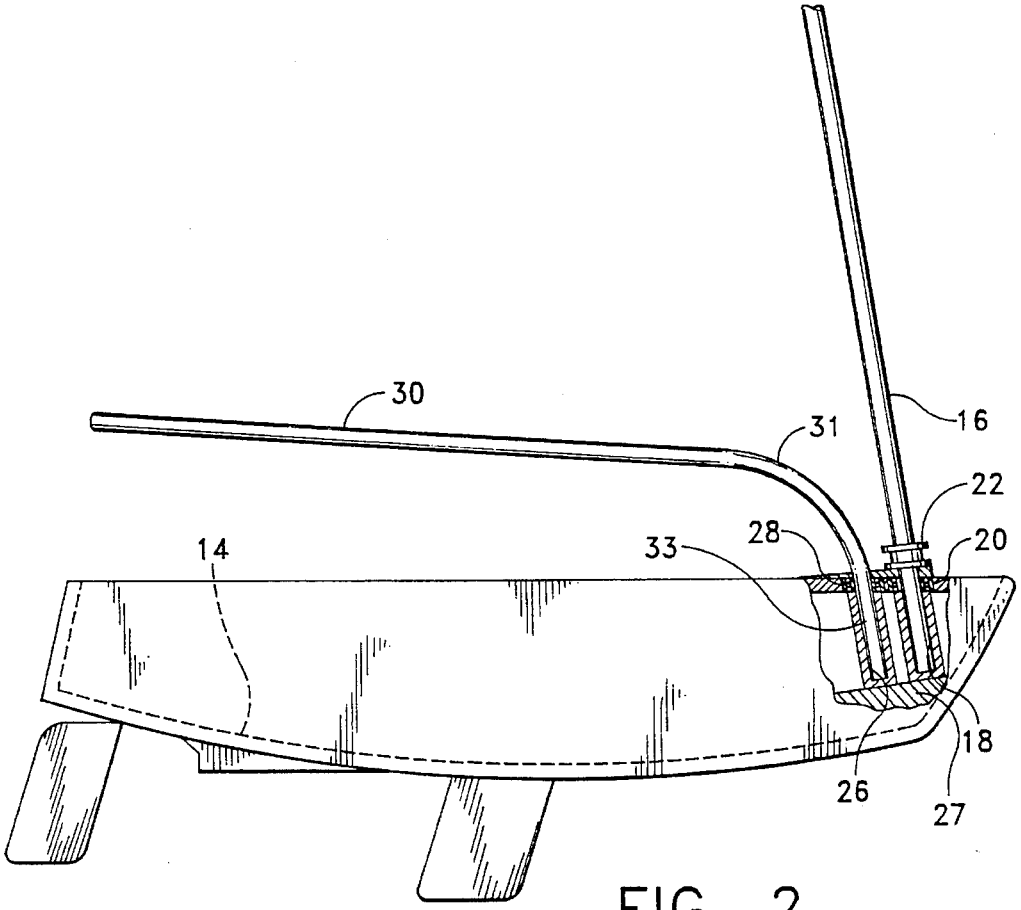
FIG. 2 is a detailed sectional view illustrating the manner of securing the boom and mast in their respective tubular sockets.
Figure 3:
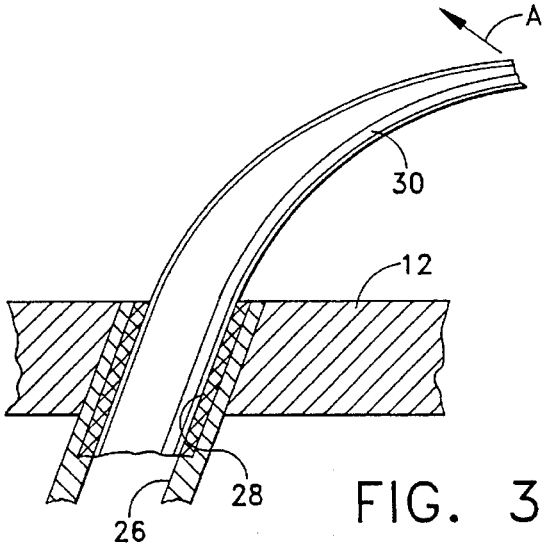
FIG. 3 is a detail sectional view illustrating a bearing sleeve.

Located immediately aft of the mast 16 is a boom socket 26 which is provided with a bearing 28 at the deck level. As seen in FIG. 2, the socket is as close as structurally permissible to the mast socket. Into the socket 26 is fitted a curved boom 30 having a forward curved section as at 31 terminating in a stub shaft 33, the arc being such that it is less than 90° so that the boom naturally takes an upward attitude over the cockpit. As seen in FIG. 2, both sockets 18 and 26 are fastened to the sail boat hull as by glassing to stringer plate 27. The sockets are parallel extending at an angle of approximately 10° to the vertical. As known in naval architecture, the angle or rake angle affects the center of effort of the sail, but for the boom to swing from side to side and maintain substantially constant leech tension, it is absolutely essential that the boom socket be parallel and closely adjacent to the mast socket. In actual practice the centers of the sockets are within 10 inches of each other and considering the diameter of the mast, the spacing between the edges of the sockets is on the order of three to four inches. This is as close as structurally permissible given the furling drum diameter.(see FIG. 2)

The boom in this condition derives its free standing support from the forward shorter stub shaft end thereof as at 33 that is constrained in a tight-fitting bearing socket 28 in the deck. The boom is suitably constructed with sufficient structural strength by utilizing known constructional techniques and is strong enough to resist the upward pull at the clew of the sail.

As seen in the drawings, a sheet means 32 is affixed somewhat centrally of the boom and to the midline of the cockpit 14. The furling line 23 that leads from the drum 22, extends through jamb cleats 24, 24', thence through a turning block 25 adjacent socket 26 and along the boom. The line then is fed around a cheek block 34, through clew grommet 38 to a dead end 36. This continuous furling line arrangement completely controls the deployment of the sail. To furl the line is disengaged from the jamb cleats 24, 24' and the starboard side of the line, as viewed in the drawings, is pulled. To unfurl, the port side of the line is pulled extending the clew and the starboard side reels up, as seen in patent to Cook, U.S. Pat. No. 4,061,101. After each operation, the line 23 is secured in the jamb cleats 24, 24'.

Figure 4:
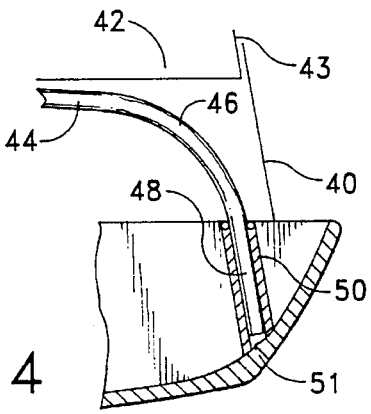
FIG. 4 is a partial sectional view of a free standing jib boom mounted on a boat.

Referring to FIG. 4, there is illustrated the bow section of a boat having a headstay 40 to which is attached a jib 42 having a luff 43. A jib boom 44 has a curved forward end 46 that terminates in a stub shaft 48. The shaft 48 is received in a socket 50 suitably tabbed to the hull as at 51. The socket has an axis that is parallel to the axis of the headstay 40 and luff 43 of the sail. As illustrated the stub shaft of the boom is mounted as close as structurally permissible to the imaginary line of extension of the luff of the sail to maintain constant leech tension.

It is apparent from the foregoing, the invention is the discovery that the pivoting angle of the boom stub shaft must match the angle of the luff of the sail it tends and that the pivot axis must be as close as structurally permissible to the imaginary line of extension of the luff of the sail. With these conditions, the leech tension may be constant. In other respects, the invention is susceptible of being embodied with various alterations and modifications which may differ particularly from those that have been described in the preceding description.

I claim:

1. A sailboat having a deck, a socket in the deck, a mast mounted through the deck into the socket for swivel movement therein, a second socket in the deck located immediately adjacent and aft of the first said socket as structurally permissible and having a bearing at the deck level for engaging a boom, said first and second sockets fastened to a section of the sailboat hull and extending at the same rake angle greater than zero degrees, a boom having an arcuate forward end received in the second socket, a mainsail connected by its luff to the mast and by its clew to the outer end of the boom and sheet means having one end fastened to the boom and the other end secured to the sailboat, whereby the leech of the sail has substantially constant tension throughout the boom travel.

2. A sailboat having a deck as in claim 1, a drum mounted on the mast and a furling line wound about the drum, said furling line being led through turning blocks to the outer end of the boom and to the clew of the sail.

3. A sailboat having a fleck, a first socket in the deck at a rake angle thereto greater than zero degrees, a second socket in the deck immediately adjacent the first socket as structurally permissible with the same rake angle as the first socket, a mast mounted in the first socket and a boom having an arcuate forward end terminating in a stub shaft received in the second socket.

4. In a sailboat having a deck, a sail having a luff, means supporting the luff on an axis rising from the deck at a rake angle, a boom having an arcuate forward section terminating in a stub shaft, means freely supporting and mounting the stub shaft of the boom for swivel movement on an axis parallel to the luff axis whereby the stub shall is at the same rake angle as the luff of the sail, said means being immediately adjacent as structurally possible and aft of an imaginary line of extension of the luff of the sail whereby the leech of the sail has substantially constant tension.

5. In a sailboat having a mast and a sail defined by a luff, foot and leech and supported by the mast, the luff extending on a line from the mast to the hull of the sailboat, that improvement for trimming the sail comprising furnishing a boom as a continuous unit with an arcuate forward end terminating in a stub shaft, means mounting the stub shaft in a socket fastened to the deck for rotational movement on an axis parallel and juxtaposed to the line of the luff, means fastening the clew to the boom whereby at all rotational positions there will be created a substantially constant leech tension.

* * * * *